United States Patent [19]

Wiley

[11] 4,119,468

[45] Oct. 10, 1978

[54] PARTICULATE METALLURGICAL HOT TOPPING COMPOSITIONS AND METHOD OF USE

[75] Inventor: Donald E. Wiley, Conneaut, Ohio

[73] Assignee: Air Products and Chemicals, Inc., Allentown, Pa.

[21] Appl. No.: 434,461

[22] Filed: Jan. 18, 1974

Related U.S. Application Data

[63] Continuation-in-part of Ser. No. 89,026, Nov. 12, 1970, abandoned.

[51] Int. Cl.[2] ..... B28B 7/36

[52] U.S. Cl. ..... 106/38.22; 75/96; 106/38.23; 106/38.27; 164/53; 249/197; 249/202

[58] Field of Search ..... 106/38.2, 38.3, 38.5 R, 106/38.9, 38.22, 38.27, 38.23; 164/53; 249/197, 200; 75/96

[56] References Cited

U.S. PATENT DOCUMENTS

| | | | |
|---|---|---|---|
| 3,144,690 | 8/1964 | Buckingham | 106/38.9 |
| 3,183,562 | 5/1965 | Moore | 249/200 |
| 3,326,273 | 6/1967 | Jago et al. | 106/38.27 |

*Primary Examiner*—Lorenzo B. Hayes

*Attorney, Agent, or Firm*—James C. Simmons; Barry Moyerman

[57] ABSTRACT

Preparation of particulate metallurgical hot topping compositions that react in situ to form a protective cover over the exposed surface of as-cast ingots. The compositions consist essentially of 9 to 33 percent by weight of oxidizing constituents, 40 to 65 percent by weight refractory constituents and 15 to 45 percent by weight of fuel constituent. Careful control of the quality and size of the major fuel constituent minimizes smoke evolution during reaction of the composition and subsequently if the covering is disturbed. By varying the ingredients in the hot topping composition, there can optionally be produced (1) a hard crust so that the as-cast ingots can be moved before a major portion of the ingot has solidified (2) a medium density crust for delayed addition of a highly exothermic hot topping composition, or (3) a low strength crust for "back-pouring" practice.

1 Claim, No Drawings

PARTICULATE METALLURGICAL HOT TOPPING COMPOSITIONS AND METHOD OF USE

CROSS-REFERENCE TO RELATED APPLICATION

This application is a continuation-in-part of application Ser. No. 89.026, filed Nov. 12, 1970, now abandoned.

BACKGROUND OF THE INVENTION

Particulate metallurgical hot topping compositions are used in the casting of metal ingots to provide an insulating cover over the top of an as-cast ingot in order to increase the feeding life of the ingot hot top. Known compositions of this type, for example, are those manufactured and sold in particulate form by Exomet, Incorporated, under the trademarks CARBON-FREE HOT TOP and RED H.T. These compositions are mildly exothermic and react in the presence of molten metal to form a light insulating layer over the ingot. The insulating layer keeps the top of the ingot molten and thereby increases soundness of the finished ingot. These compositions react with the evolution of large quantities of dense smoke obliterating safe walkways and a large portion of the pouring area from the view of cranemen.

In normal practice after an ingot has been poured, the particular material is shoveled or placed by the bag on the molten metal surface. The particulate composition flows over the metal surface thereby completely covering the surface before reacting to form the crust.

Particulate compositions of this type are formulated to react exothermically to produce an insulating covering on the surface of molten metal at the top of an ingot. Before reacting to form the covering, the compositions are in the form of loose particulate material that has been blended or formulated at room temperature and has not been subjected to elevated temperature treatment, e.g. above ambient temperature.

Conventional monolithic (pressed and sintered) solid exothermic hot tops are usually made from a particulate material such as disclosed in U.S. Pat. No. 3,144,690, sintered at low temperature (e.g. 200° C or 482° F) to form solid panels such as shown in U.S. Pat. No. 3,183,562 and then when contacted by the molten metal react exothermically to liberate large quantities of heat to keep the top of the ingot molten. The surface temperature of the molten metal is about 300° F (1649° C) at which temperature a particulate composition with conventional binders as exemplified by the above U.S. patents would react exothermically to form an irregular sintered mass that would float on the molten metal rather than form a crust. In order to form a uniform article, such compositions must be sintered at low temperature for a prolonged time. The basic compositions used for molded hot tops and other molded and cured articles are not referred to as hot topping compositions (compounds) by those skilled in the art since the art recognizes that the compositions to be moldable must have a binder.

The hot topping compositions, such as mentioned above, have been very satisfactory when used with ingots poured from molten metal produced in conventional open hearth, electric furnace, or induction furnaces. With these types of melting facilities, the ingots are allowed to stand for a long period of time before being moved to the place where the mold is stripped away from the ingot. The long delay time was necessary to allow a large portion of the ingot to solidify before it was disturbed. Moving as-cast ingots covered with conventional compositions would result in molten metal breaking open the hot topping crust and thereby exposing the metal to air reducing the effectiveness of the hot topping by increasing the solidification rate of the metal. In addition, exposing the crust to air caused it to burn and evolve more smoke. With the advent of the basic oxygen furnace, many steel mills have found it necessary to move the ingots within a short time after pouring so that the pouring platform is available for a next heat, which usually takes place within an hour of the previous pour. This "fast-move" practice has made it necessary either to delay application of the hot topping composition or to use a double application (before and after move) or use a highly exothermic composition in conjunction with the hot topping composition. These measures result in reduced efficiency and increased smoke evolution.

In some instances, it is desirable to remelt the solidified metal in the ingot hot top to further increase the yield of sound ingot metal by feeding the ingot shrink cavity. In order to do this, it is necessary to add a highly exothermic material on top of the hot topping composition to react and liberate large amounts of heat. If the hot topping composition contains volatile components, it will react and further increase the volume of smoke evolution.

In some steel mills where there is more metal produced on a given heat than there are available ingot molds, it is common practice to fill all of the ingots and then starting with the first ingot poured refill or brackpour all of the ingots. In order to accomplish this, it is necessary to have a readily displaceable hot topping composition that evolves a minimum amount of smoke.

SUMMARY OF THE INVENTION

It has now been discovered that the above-mentioned problems can be minimized or avoided by controlling the composition and quality of ingredients that are contained therein, thereby providing hot topping compositions that react in situ to form a crust with a minimum of smoke evolution.

It has further been found that by controlling the kinds and amounts of the components of the hot topping composition, a dense high strength, medium strength, or powdery low strength crust can be optionally formed over the surface of the molten metal in the ingot.

Therefore, it is the primary object of this invention to provide a crusting, hot topping composition that minimizes dense smoke evolution during reaction and subsequent thereto.

It is still another object of this invention to provide a hard crusting, hot topping composition that will not be displaced by molten metal in the ingot mold.

It is yet another object of this invention to provide a medium density crusting, hot topping composition having a high temperature secondary burn that minimizes dense smoke evolution when used in conjunction with a second highly exothermic composition.

It is a further object of this invention to provide a crusting hot topping composition wherein the reacted crust is of low burnt density.

DETAILED DESCRIPTION OF THE PRFERRED EMBODIMENT

Hot topping compositions, in accordance with one embodiment of the invention, which react to form a hard crust when applied to a molten ingot are those consisting essentially of 9 to 30 percent by weight of oxidizing constituents, 40 to 65 percent by weight of refractory components, and 15 to 45 percent by weight of fuel constituents.

Suitable oxidizing constituents are red iron oxide, millscale of less than 50 mesh (Tyler Standard Sieve series used throughout) particulate size, calcium sulfate in the form of gypsum, sodium nitrate, manganese dioxide and mixtures thereof.

The refractory components are selected from the group consisting of sand, lime, siliceous volcanic rock, foliated micaceous minerals, calcined bauxite, calcined alumina, and aluminum dross. The aluminum dross contains approximately 80 percent $Al_2O_3$ which is highly refractory. Generally, balance of the dross is primarily aluminum, which is a major fuel component. Composition of the dross will vary as it is a by-product from primary aluminum manufacturing operations. The composition usually depends upon the mill from which it is obtained, however, the 80–20 estimate is generally accepted in the art.

The fuel constituent is basically aluminum, from the dross or as finely divided particles in combination with an ignition material. The preferred ignition material is dextrin which is necessary in certain compositions in order to initiate the reaction. The finely divided aluminum may be in the form of foil, turnings, or aluminum grindings sized so that approximately 85% by weight of metal will pass a 12 mesh screen and be retained on a 150 mesh screen.

Within the above compositional ranges, it has been discovered that to minimize smoke evolution careful control of the $Al_2O_3$ must be achieved. If the $Al_2O_3$ is introduced in the form of aluminum dross, the dross must be washed to eliminate nitrides and chlorides of aluminum. Such washing may be accomplished, for example, by leaching the dross with inhibited water. It is preferable to eliminate the dross as a source of $Al_2O_3$; however, this increases the cost of the composition. It is also necessary to introduce the $Al_2O_3$, if in the form of calcined bauxite or washed dross, into the composition with at least seventy (70) percent falling within the size range of $-12$ to $+150$ mesh according to a standard Tyler Standard Sieve Series. The particle size range of dross is determined before the dross is washed. Since the calcined alumina has the consistency of granular sugar only about 30% of the particles need be $+150$ mesh to achieve the same results. Maintaining the calcined bauxite and calcined alumina source of $Al_2O_3$ or washed dross within the above particle size range minimizes or eliminates dense smoke evolution during and after reaction of the hot topping composition.

The density and strength of the crust can also be controlled by proper blending of ingredients within the compositional ranges. By proper balancing of $Al_2O_3$, $SiO_2$, and FeO with respect to the aluminum content, it is possible to form either a hard, medium, or powdery crust in situ. If the $SiO_2$ and FeO contents are increased, a hard crusting mixing usually results. Increasing the $SiO_2$ tends to lower the melting point of the crust forming a liquid or tacky phase while the composition is reacting, and then forms a sintered mass after reaction is complete. Increasing the iron oxide content serves two purposes. It enhances formation of the liquid or tacky phase in situ and also promotes a faster, hotter burn which is desirable in the "fast-move" practice. Overall, it has been discovered that if the ratio of iron oxide (FeO) plus alumina ($Al_2O_3$) plus silica ($SiO_2$) to aluminum is between 1.4 to 1 and 10/1 the hot topping compositions will form crusts with minimum smoke evolution.

If the $Al_2O_3$ content is increased, the crust tends to become powdery. If a powdery crust suitable for backpouring of ingots is required, it is preferable to add the increased quantity of $Al_2O_3$ is calcined bauxite having a particle size so that at least 70% by weight falls within the size range of $-12$ to $+150$ mesh or calcined alumina in a particle size range so that at least 90% by weight of the particles fall within the range of $-50$ to $+270$ mesh.

Typical Tyler Sieve analyses for the unwashed aluminum dross and alumina in the calcined bauxite and calcined alumina are as follows:

| Screen Size (mesh) | % of Sample Retained | | |
|---|---|---|---|
| | Dross | Bauxite | Cal. Alumina |
| +12 | 6.7 | — | — |
| +20 | 24.5 | 3.9 | — |
| +35 | 20.9 | 16.9 | — |
| +50 | 9.0 | 16.9 | — |
| +100 | 12.2 | 27.6 | 7.0 |
| +150 | 5.9 | 9.5 | 27.7 |
| +200 | 5.9 | 6.1 | 33.6 |
| +270 | — | 6.8 | 26.8 |
| +325 | — | 2.8 | 2.9 |
| Pan | 14.9 | 9.5 | 2.0 |

In the foregoing analyses, the dross is unwashed; during washing of the dross, most of the finer (e.g. $-150$ mesh) particles will be lost.

A suitable hard crusting hot topping composition was formulated as follows:

| Component | Percent by Weight |
|---|---|
| Iron Ore | 6.0 |
| Red Iron Oxide | 6.0 |
| Sodium Nitrate | 6.0 |
| Lime | 6.0 |
| Sand | 57.8 |
| Finely Divided Aluminum | 18.0 |
| Ignitor (Dextrin) | 0.2 |
| $\frac{FeO + Al_2O_3 + SiO_2}{Al}$ | 3.86/1 |

The above composition when placed in a 6¼ inches diameter riser in a newly poured casting reacted nonviolently with almost no dense smoke evolution, and produced the desired hard crust. In the above mixture, the oxidizing content was 18 percent by weight consisting of iron ore, red iron oxide, and sodium nitrate, the refractory content 63.8 percent by weight consisting of sand and lime, and the fuel content 18.2 percent by weight. The fuel content includes 0.2% by weight dextrin to initiate the reaction when the composition is placed on the molten metal.

The sand can be replaced in whole or in part by aluminum dross, ground fire clay, siliceous volcanic rock containing 70 to 80% silica, commonly called mineral perlite, foliated micaceous minerals such as sold under the tradenames Sil-O-Cel and Vermiculite, or a clay such as Calamo 35 which consists of 35–50% $Al_2O_3$ and 40–60% silica with small amounts of other oxides. By replacing the sand with one of these materials, it is possible to change the characteristics of the hot topping composition but still retain its ability to form a hard crust. For example, mineral perlite reduced bulk density of the mix, Vermiculite causes bloating and reduction of the burnt (reacted) density.

Set forth in Table I are a series of hot topping compositions that were formulated and tested. In each case, a crusting cover was formed on top of the metal ingot or riser.

The following examples are illustrative of hot topping compositions that when reacted on a steel ingot produce the desired insulating crust and then exhibit a secondary burn. The secondary burn is desirable to prolong the feeding life of the hot top. This mixture results in temperatures in excess of 3500° F.

TABLE I

| Component | Mixture Number 1 | 2 | 3 | 4 | 5 | 6 | 7 | 8 | 9 | 10 | 11 | 12 | 13 |
|---|---|---|---|---|---|---|---|---|---|---|---|---|---|
| Iron Oxide | 9.3 | 6.7 | 10.2 | 12.0 | 11.5 | 27.2 | 11.8 | 12.0 | 9.5 | 14.5 | 7.5 | 8.2 | 15.0 |
| Gypsum | — | — | — | — | — | — | 3.5 | 3.5 | 2.0 | 1.0 | — | — | — |
| $MnO_2$ | — | — | — | — | — | — | — | — | — | — | 3.0 | — | — |
| Sodium Nitrate | 10.3 | 14.0 | 4.2 | 6.0 | 5.5 | 4.5 | 4.2 | 4.2 | 6.0 | 4.0 | — | 4.2 | 8.0 |
| Aluminum | 11.0 | 4.0 | 1.4 | 18.4 | 18.4 | 19.5 | 7.7 | — | 18.4 | 7.7 | — | — | 20.0 |
| Aluminum Dross | 33.5 | 66.7 | 78.2 | — | 19.0 | — | 48.4 | 40.0 | — | 78.4 | 85.0 | 79.1 | — |
| Ignitor | — | — | — | 0.2 | 0.2 | — | 2.1 | 2.0 | 0.2 | 2.1 | — | — | — |
| Sand (Silica) | 28.9 | — | — | 28.7 | 39.5 | 44.3 | 18.1 | — | 28.7 | 18.1 | — | 8.3 | — |
| Clay | — | — | 5.0 | 28.7 | 1.2 | — | — | — | 28.7 | — | — | — | 4.0 |
| Bauxite | — | — | — | — | — | — | — | 34.0 | — | — | — | — | 52.0 |
| Perlite | 2.7 | 5.3 | — | — | — | — | 2.8 | 2.8 | — | 2.8 | 3.5 | — | — |
| Finely Divided Carbon | 1.6 | 3.3 | — | — | — | — | — | — | — | — | 1.0 | 0.2 | — |
| Lime | 3.0 | — | — | 6.0 | 4.7 | 4.5 | 1.4 | 1.5 | 6.0 | 1.4 | — | — | 1.0 |
| $\frac{FeO + Al_2O_3 + SiO_2}{Al}$ | 3.66/1 | 3.44/1 | 3.56/1 | 3.78/1 | 3.04/1 | 3.65/1 | 3.93/1 | 9.75/1 | 3.62/1 | 4.1/1 | 2.34/1 | 5.1/1 | 3.02/1 |

In the examples of Table I, mixture numbers 7 and 10 are the preferred compositions for a low smoke evolving hard crusting hot topping composition. They are ideally suited for fast-move practice in BOF shops. The crust of either mixture does not smoke even if intentionally broken after complete reaction. Mixture number 4 is identical to mixture number 7 in properties and was found to evolve the lowest quantity of smoke. It is expensive to manufacture and can be covered with a highly exothermic topping material such as disclosed in U.S. Pat. No. 3,713,852 to get remelting of hot tops with no smoke evolution. Mixture number 9 is almost identical in properties to mixture number 4. For this latter application, calcined alumina should replace the sand to soften the as-formed crust to allow proper working of the highly exothermic addition.

Mixture number 3 is typical of a hot topping composition that reacts to form a medium strength crust.

Mixture number 2 is typical of a mixture to which mineral perlite has been added to reduce its density. In this mixture, if the dross is not washed and screened as set forth above, the mixture would cause large amounts of smoke evolution during reaction.

Mixture number 1 is typical of a hot topping composition that has low bulk density, a medium crust, and low smoke evolution during and after reaction. The density is decreased by using perlite, the crust modified by the addition of sand and lime and the smoke evolution minimized by using aluminum metal and washed and screened dross.

Mixture number 6 was formulated to have a faster reaction time because of the increased FeO and $SiO_2$ content. Upon reaction the crust is almost liquid.

Mixtures 8, 11, and 12 are illustrative of hot topping compositions that react to form a powdery crust suitable for back-pour practice. In mixture number 8, sand was replaced with calcined alumina (bauxite) and the aluminum was introduced in the form of a washed and screened dross. Mixtures 11 and 12 illustrate the use of alumina and aluminum in the form of dross to achieve the same result without resorting to sand or bauxite. Mixture 15 is illustrative of a hard crusting composition that can be achieved without the use of dross as the source of alumina and without silica as the refractory component.

| Component | Mixture A (% by weight) | $A_2$ (% by weight) | $A_3$ (% by weight) |
|---|---|---|---|
| Iron Oxide | 6.3 | 6.8 | 2.7 |
| Aluminum Powder | 26.1 | 2.0 | 17.0 |
| Aluminum Dross | 60.3 | 78.2 | 77.3 |
| Gypsum | 1.5 | 3.2 | 0.9 |
| Manganese Dioxide | 2.9 | 2.0 | — |
| Sodium Nitrate | — | 7.8 | 1.8 |
| Sand | 1.9 | — | — |
| Perlite | 1.0 | — | — |
| Vermiculite | — | — | 0.3 |
| $\frac{FeO + Al_2O_3 + SiO_2}{Al}$ | 1.48/1 | 3.85/1 | 2.77/1 |

In the above, Mixture A, the dross content, can be increased and the aluminum powder commensurately decreased thereby achieving a secondary burn of lower intensity as was found to be the case with Mixture $A_1$. The gypsum is added to promote the desired secondary burn, its content affecting secondary burn temperature.

Generally, the above mixtures are dry blended and packaged in bags, cans, or drums for shipment to the customer. Mechanical mixing devices can be employed as is customary in the art.

The above mixtures are in particulate form such as powder or granules when applied to the surface of the molten metal.

In use, the molten metal (e.g. steel) is poured into an ingot mold allowing for headroom in the ingot above the molten metal. If a solid hot top is used, the same procedure applies. The headroom is basically a reservoir defined by the ingot hot top walls and molten metal with an open top. This is sometimes referred to as pouring an ingot down 2 inches or 4 inches or the depth depending upon melt shop practice. The topping mixture is placed in the reservoir by bag, shovel, hand, or other convenient means flowing over the surface of molten metal and then reacting to form the crust and sealing against the ingot or hot top walls.

What is claimed is:

1. A metallurgical hot topping composition that when placed on the exposed molten metal in an ingot mold reacts to form a self-supporting insulating crust and then exhibits secondary burn to prolong the feeding life of the hot top reservoir metal consisting essentially of:

6.3 to 6.8% by weight iron oxide;

2.0 to 26.1% by weight aluminum powder;

60.3 to 78.2% by weight washed aluminum dross having an unwashed particle size so that about 70% by weight of the dross passes a 12 mesh screen and is retained on a 150 mesh screen;

1.5 to 3.2% by weight gypsum;

2.0 to 2.9% by weight manganese dioxide;

0 to 7.8% by weight sodium nitrate;

0 to 1.9% by weight silica sand; and 0 to 1.0% by weight siliceous volcanic rock containing 70 to 80% by weight silica;

said composition being formulated so that the ratio of $FeO + Al_2O_3 + SiO_2$ to Al is between 1.48/1 to 3.85/1.

* * * * *

UNITED STATES PATENT AND TRADEMARK OFFICE

CERTIFICATE OF CORRECTION

PATENT NO. : 4,119,468

DATED : October 10, 1978

INVENTOR(S) : Donald E. Wiley

It is certified that error appears in the above-identified patent and that said Letters Patent are hereby corrected as shown below:

Title Page, Item 73

Change Assignee from "Air Products and Chemicals, Inc., Allentown, Pa." to -- Exomet, Incorporated, Conneut, Ohio --

Column 1, Line 28

Change "particular" to -- particulate --

Column 2, Line 32

Change "brack-" to -- back- --

Columns 5 and 6, Table 1, Column 3 thereunder, last number

Change "3.56/1" to -- 4.56/1 --

Signed and Sealed this

Sixteenth Day of January 1979

[SEAL]

Attest:

RUTH C. MASON
Attesting Officer

DONALD W. BANNER
Commissioner of Patents and Trademarks